US009447796B2

(12) United States Patent
Han

(10) Patent No.: US 9,447,796 B2
(45) Date of Patent: Sep. 20, 2016

(54) ANNULAR JET PUMP

(76) Inventor: Tiefu Han, Xiamen (CN)

( * ) Notice: Subject to any disclaimer, the term of this patent is extended or adjusted under 35 U.S.C. 154(b) by 451 days.

(21) Appl. No.: 13/978,879

(22) PCT Filed: Aug. 6, 2012

(86) PCT No.: PCT/CN2012/080354

§ 371 (c)(1),
(2), (4) Date: Aug. 3, 2013

(87) PCT Pub. No.: WO2013/029476

PCT Pub. Date: Mar. 7, 2013

(65) Prior Publication Data

US 2013/0323089 A1 Dec. 5, 2013

(30) Foreign Application Priority Data

Aug. 31, 2011 (CN) ..... 2011 1 0255503

(51) Int. Cl.

| | |
|---|---|
| ***F04F 5/46*** | (2006.01) |
| ***B05B 1/34*** | (2006.01) |
| ***B05B 7/04*** | (2006.01) |
| ***F04F 5/04*** | (2006.01) |
| ***F04F 5/16*** | (2006.01) |

(52) U.S. Cl.

CPC ..... *F04F 5/463* (2013.01); *B05B 1/3415* (2013.01); *B05B 7/045* (2013.01); *B05B 7/0458* (2013.01); *B05B 7/0491* (2013.01); *F04F 5/04* (2013.01); *F04F 5/16* (2013.01)

(58) Field of Classification Search

CPC ... B05B 7/045; B05B 7/0458; B05B 7/0491; B05B 7/0441; F04F 5/00; F04F 5/02; F04F 5/14; F04F 5/24; F04F 5/30; F04F 5/461; F04F 5/463; F04F 5/466; F04F 5/467

USPC ..... 417/167, 168, 170, 177, 179

See application file for complete search history.

(56) References Cited

U.S. PATENT DOCUMENTS

| | | | | | |
|---|---|---|---|---|---|
| 137,651 | A * | 4/1873 | Benson | F04F 5/461 | 417/183 |
| 2,164,263 | A * | 6/1939 | Wall | F04F 5/466 | 417/179 |
| 2,190,109 | A * | 2/1940 | Tinker | F04F 5/46 | 417/163 |

FOREIGN PATENT DOCUMENTS

| | | | |
|---|---|---|---|
| CN | 101625000 | A | 1/2010 |
| RU | 2195586 | C2 | 12/2002 |
| SU | 1474340 | A1 | 4/1989 |
| SU | 1710856 | A1 | 2/1992 |

OTHER PUBLICATIONS

Ma Xiaoyan, The International Searching Authority written comments, Nov. 2012, CN.

* cited by examiner

*Primary Examiner* — Devon Kramer
*Assistant Examiner* — Kenneth J Hansen

(57) ABSTRACT

An annular ejector of an annular jet pump is coaxially arranged at a front of a central ejector. The annular ejector includes an annular nozzle, an annular mixing chamber, and an annular mixing duct. The central ejector includes a central nozzle, a central mixing chamber, and a central mixing duct. The annular nozzle is connected with a primary fluid inlet. A primary fluid inlet is in direct connection with the central nozzle arranged at a bottom of the central pipe, and a secondary fluid inlet is connected with a sidewall of the annular mixing chamber.

17 Claims, 6 Drawing Sheets

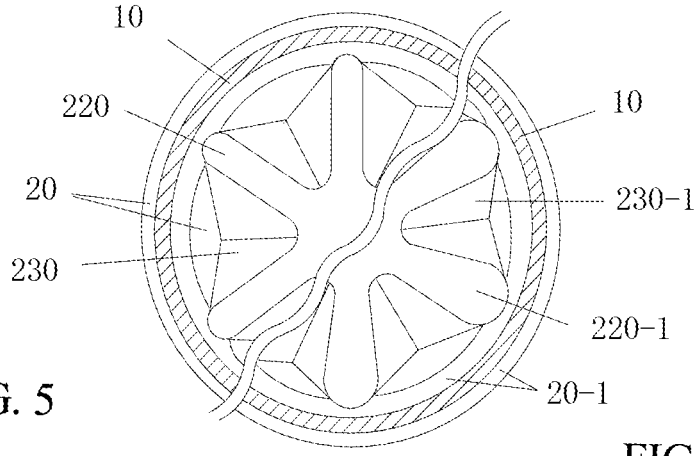
FIG. 5
FIG. 6
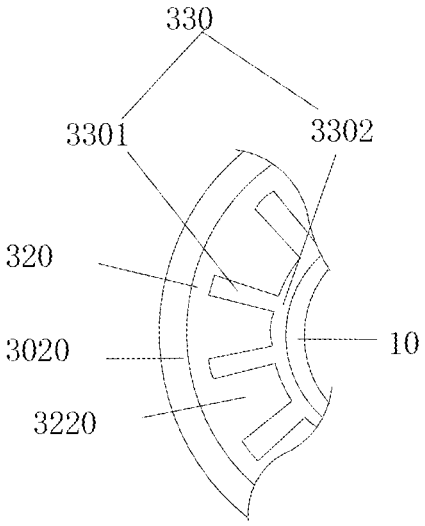
FIG. 7
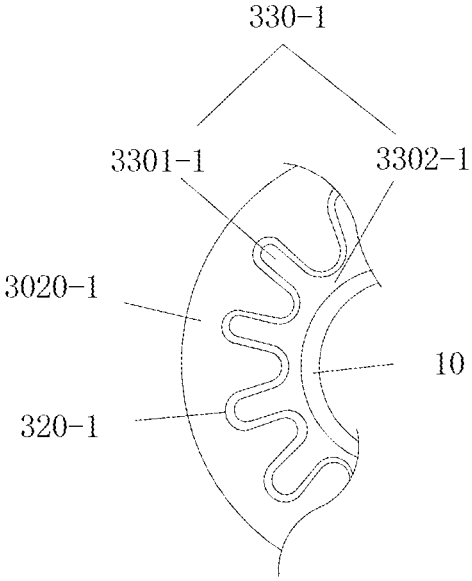
FIG. 8

ANNULAR JET PUMP

TECHNICAL FIELD

The present disclosure relates to a mixed flow element, and more particularly to an annular jet pump.

BACKGROUND

A jet pump is a mixed flow element, where a primary fluid having a high pressure ejects a secondary fluid having no or low pressure through the jet pump, and where the jet pump outputs a mixed fluid having an intermediate pressure. The most typical ejector is a Venturi ejector, where a body of the Venturi ejector is a circular pipe having an expanding cavity (namely a mixing chamber) at a front end of the circular pipe. An inlet of the secondary fluid is arranged at a side of the mixing chamber, and a nozzle connected with an inlet of the primary fluid is arranged in the mixing chamber. An outlet of the nozzle faces a mixing-output duct having a small diameter. The mixing-output duct is connected with an outlet of a contracting portion of the mixing chamber.

The Venturi ejector allows the primary fluid (namely working fluid) to entrain the ejected secondary fluid in the mixing chamber and enter into the mixing-output duct through the nozzle, which mixes the primary fluid and the secondary fluid in the circular pipe, controls heat and mass transfer and average pressure, and outputs the mixed fluid at an end of the circular pipe. Thus, delivery of the mixed fluid of the high pressure primary fluid entraining the low pressure secondary fluid is achieved.

Structure of the ejector with a single pipe has been largely unchanged. The ejector has a simple structure and reliable performance, but the ejector has the following defect:

To fully mix the primary fluid (the working fluid) and the secondary fluid (the ejected fluid), a long mixing duct (or a mixing-diffusion duct) is used. However, because the typical ejector is heavy and large, it is not useful in conditions that demand a light and small sized ejector. If the jet pump has the single pipe with a large diameter and large flow rate to spray the fluid and suck up the gas, the jet pump needs to have the mixing duct with a large diameter, and needs to have a jet flow of a large-diameter beam primary fluid. Because a jet flow of the primary fluid is in a center of the mixing chamber, the secondary fluid is entrained around the jet flow beam of the primary fluid, and as diameter of the jet flow of the primary fluid increases, a percent unit area contact rate and entrainment rate of the primary fluid and the secondary fluid reduces, namely ejecting coefficient of the primary fluid reduces, thus, effect of sucking up the gap (the secondary fluid is gap) reduces. To fully mix the primary fluid and the secondary fluid, and control heat transfer, mass transfer and average pressure, a length of the mixing duct (or the mixing-diffusion duct) increases, which results in reducing ejecting efficiency of the jet pump and increasing an axial size of the jet pump.

Pat No. ZL200920106414.7 provides an annular jet pump having a plurality of nozzles. The annular jet pump includes a plurality of small ejectors communicating with a central total pipe and circularly arranged in an external annular casing pipe, each of the small ejectors includes a nozzle, a throat pipe, and a diffusion pipe. The annular jet pump allows a high pressure fluid to eject a low pressure stratum fluid to a ground, and extract oil. The annular jet pump is a first-order parallel jet pump including a ring small round pipes in parallel and a central ball non-return valve. However, the annular jet pump structure is suited for extracting underground oil, but cannot be used as a large flow jet pump.

SUMMARY

In view of the above-described problems, the aim of the present disclosure is to provide an annular jet pump that has good performance in a condition of a large flow, achieves a high mixing output pressure in a condition of good ejecting rate, and avoids a big axial size of the jet pump and a low ejecting efficiency of the jet pump.

The aim of the present disclosure is achieved by the following methods.

An annular jet pump comprises an external pipe, a central pipe, an annular end cover, a central nozzle, and an annular nozzle. Where the external pipe successively comprises a large-sized-diameter portion, a first contracting portion, a transition portion, a second contracting portion, and a posterior straight pipe portion arranged from front to back along a central axis of the external pipe. The annular end cover seals off a front end of the large-sized-diameter portion of the external pipe, the central pipe is in fixed connection with a central hole of the annular end cover and coaxially extends into the transition portion of the external pipe.

A front end of an inner bore of the central pipe is configured with a primary fluid inlet and a rear end of the inner bore of the central pipe is configured with the central nozzle. The annular nozzle is arranged between the central pipe and the large-sized-diameter portion of the external pipe, and an annular flow passage is formed between the annular end cover and the annular nozzle, the annular flow passage communicates with the inner bore of the central pipe and an inlet of the annular nozzle.

An annular mixing chamber is formed among the central pipe behind the annular nozzle, the large-sized-diameter portion of the external pipe, and the first contracting portion. A secondary fluid inlet is arranged at a sidewall of the annular mixing chamber corresponding to the large-sized-diameter portion of the external pipe, an annular mixing duct is formed between the central pipe and the transition portion of the external pipe. A central mixing chamber is formed by the transition portion of the external pipe located behind the central pipe and the second contracting portion of the external pipe, and a central mixing duct is formed by the posterior straight pipe portion of the external pipe.

An annular ejector is formed by the annular nozzle, the annular mixing chamber, and the annular mixing duct. A central ejector is formed by an outlet of the annular mixing duct, the central nozzle, the central mixing chamber, and the central mixing duct; the annular ejector is coaxially arranged at a front end of the central ejector.

An outlet of the annular nozzle of the annular ejector extends into the annular mixing chamber, and faces a contracting cone mouth of a rear of the annular mixing chamber and the outlet of the annular mixing duct.

An outlet of the central nozzle of the central ejector and the outlet of the annular mixing duct around the central nozzle smoothly butt and directly communicate with an inlet of the central mixing chamber, and the outlet of the central nozzle faces an outlet of the central mixing duct.

The primary fluid flows from the primary fluid inlet, one part of the primary fluid flowing through an annular flow passage is sprayed by the annular nozzle, and ejects a secondary fluid in the annular mixing chamber. The secondary fluid and the primary fluid flow together into the annular mixing duct and are mixed, and an annular mixed fluid is output. Another part of the primary fluid sprays toward the outlet of the central mixing chamber through the central nozzle, and ejects the annular mixed fluid from the annular mixing duct. The annular mixed fluid and the primary fluid flow together into the central mixing duct and are mixed, and are output, which achieves mixing and delivery of the high pressure primary fluid pumping the low pressure secondary fluid.

The annular jet pump of the present disclosure is configured with the annular ejector at the front of the central ejector, which improves the ejecting rate of the high pressure primary fluid ejecting the low mixing pressure secondary fluid. Because the annular mixing chamber and the annular mixing duct of the annular ejector have an annular-section flow passage, and a wall width of the annular-section flow passage is small, an flow area of the annular-section flow passage is big, the contact rate and entrainment rate of the primary fluid and the secondary fluid increase. Additionally, a lateral migration of the fluid caused by a nonuniform flow of the annular-section flow passage improves heat transfer, mass transfer, and mixing between the primary fluid and the secondary fluid, so the annular jet pump has higher contact rate, and shorter and lighter mixing duct than the signal pipe ejector. The primary fluid ejects twice in the present disclosure, and the primary fluid flowing from the central ejector may effectively eject and mix the annular mixed fluid flowing from the preceding stage annular ejector, which increases the output pressure of the annular mixed fluid. The ejecting rate and output pressure are opposite quotas, and keep good balance in the condition of large flow, and the performance of the annular jet pump is better than the jet pump having the signal ejector.

An external flange is arranged at a periphery of the central pipe near the annular end cover, and an intermediate casing pipe is arranged between the external flange and a front end of the large-sized-diameter portion of the external pipe, the intermediate casing pipe moves forward and backward between the external flange and the front end of the large-sized-diameter portion of the external pipe. The annular mixing duct is diminishing back taper, and has a flow passage having a uniform cross-section and a reduced cross-section. When a position of between the intermediate casing pipe and the large-sized-diameter portion of the external pipe may be adjusted, the central pipe and the intermediate casing pipe move forward and backward along the axis line relative to the external pipe, thus a flow path of the annular mixing duct and a distance between the annular mixing duct and the annular nozzle are changed, and an exemplary characteristic parameter of the annular jet pump of the present disclosure may be achieved through the above method.

The annular flow passage and the annular nozzle are formed between the external flange of the central pipe and the intermediate casing pipe, which reduces difficulty degree of processing the annular flow passage and the annular nozzle, and reduces costs.

The annular nozzle comprises an annual seam, a groove arranged circularly and uniformly, or a combination of the annual seam and the groove, which are arranged between the external flange of the central pipe and the intermediate casing pipe; the annual seam is circular slit, a lobe groove or a flat cogging; a cross section of the groove arranged circularly and uniformly is radial distribution; a longitudinal section of the groove arranged circularly and uniformly is parallel or inclined to a central axis of the annular nozzle.

If the annular seam is the circular slit, the annular nozzle has a simple structure and is easy to manufacture. If the annular seam is the circular slit and an inside of the circular slit is configured with a plurality of connecting grooves having a braid-shaped groove or a flat gear, the slit having a braid-shaped groove or a flat gear communicates with the annular seam. The primary fluid is ejected from the plurality of grooves when the annular jet pump works, which forms a plurality of narrow-stripy jet flows of the primary fluid, the plurality of narrow-stripy jet flows of the primary fluid are circularly arranged. A flat-stripy secondary fluid is arranged between two adjacent narrow-stripy jet flows of the primary fluid, and the flat-stripy primary fluid and secondary fluid are arranged by turns in the mixing chamber, which increases the contact surface of the primary fluid and the secondary fluid, and improves the mixing efficiency of the primary fluid and the secondary fluid, thereby reducing the length of the mixing duct, reducing the length and the weight of the annular jet pump, and improving the capacity and the ejecting efficiency of the annular jet pump. The surface of the flat-stripy jet flow of unit volume is more than the surface of the cylindrical jet flow of unit volume, which improves the capacity of the primary fluid entraining the secondary fluid, namely improving the ejecting rate of the annular jet pump and the capacity of the annular jet pump entraining the secondary fluid. If the annular nozzle is formed by the grooves circularly arranged, the annular nozzle has a simple structure, and is easy to manufacture. The annular nozzle has many patterns, and the pattern of the annular nozzle may be elected according to different conditions. If the annular nozzle comprises the plurality of inclining grooves or inclining holes, the annular nozzle has the capacity of swirling, the declining jet flow of the annular nozzle forms a rotary moving in the mixing chamber and the mixing duct, which increases the distance and the moving time of the fluid in the short mixing duct, thereby improving the contact time of the primary fluid and the secondary fluid, and the heat transfer and the mass transfer between the primary fluid and the secondary fluid. The mixing degree of the primary fluid and the secondary fluid is increased because of inertia force, centrifugal force, and dynamic pressure of the rotary jet flow, which improve the energy exchange and the mixing efficiency of the primary fluid and the secondary fluid, and increase the entire capacity of the annular jet pump in the condition of the large flow.

The external flange is configured with a plurality of vertical through holes and transverse through holes that arranges alternately and are isolated to each other; the vertical through holes passes through a front end and a rear end of the external flange of the central pipe, and connects a second secondary fluid inlet of the annular mixing chamber with an outside. The transverse through holes connects the inner bore of the central pipe with the annular flow passage. The structure increases the using field and function of the annular jet pump through the second secondary fluid.

The annular nozzle comprises a plurality of straight round holes or inclining round holes circularly and uniformly arranged, the plurality of straight round holes or inclining round holes are arranged at an annular nozzle holder. The annular nozzle holder is arranged between the central pipe and the external pipe. Thus, the annular nozzle has the simple structure and is easy to manufacture. The annular nozzle may also comprise a circular groove having a U-shaped cross section or a V-shaped cross section, and the plurality of straight round holes or inclining round holes circularly and uniformly arranged. The circular groove is arranged at a bottom of the annular nozzle holder, and the plurality of straight round holes or inclining round holes are arranged at the annular nozzle holder, the annular nozzle holder is arranged between the central pipe and the external pipe. Outlets of the plurality of straight round holes or declining round holes are connected with the circular groove. The circular groove nozzle having the U-shaped or V-shaped cross section allows the jet flow in the annular nozzle to cause a lateral migration of the primary fluid flowing through the annular mixing duct, which benefits the diffusion of the jet flow in the annular mixing duct, adds the function of the piston, and improves wall-attachment effect, thus the primary fluid and the secondary fluid are fully mixed at the time of initial confluence, thereby improving the mixing degree and the speed of heat transfer and mass transfer. The annular nozzle may also comprise the plurality of straight round holes or inclining round holes circularly and uniformly arranged, the plurality of straight round holes or inclining round holes are arranged at the annular nozzle holder arranged between the central pipe and the external pipe. A radial wedge slot is arranged at a center of the outlet of the straight round hole or inclining round hole, which forms an eye-shaped-hole sprayer port. The advantages of the annular nozzle having the eye-shaped-hole sprayer port are following: 1. fully mixing the primary fluid and the secondary fluid in the annular mixing chamber, which reduces the length and the weight of the annular mixing duct. 2. the annular mixing duct is filled with the atomization jet flow having the function of the piston and generated by few primary fluids, thereby improving the capacity of the primary fluid entraining the secondary fluid, namely the ejecting efficiency of the annular jet pump.

The central nozzle is a cone-shaped nozzle. The central nozzle may also be a scaling nozzle having a small diameter in a middle of the central nozzle relative to a front end of the central nozzle and a rear end of the central nozzle, which has the simple structure and is easy to manufacture. The central nozzle may also be a multi-hole nozzle having a plurality of straight holes or oblique holes uniformly arranged, the central nozzle has the function of the atomizing and swirling, thereby improving the mixing efficiency of the primary fluid and the secondary fluid in the central mixing duct. The central nozzle may also be a lobe nozzle having a hollow lobe groove, a hollow lobe groove with a large end, or a radial groove. The lobe nozzle has the annular seam and the hollow lobe groove, the hollow lobe groove with the large end, or the radial groove. The hollow lobe groove, the hollow lobe groove with the large end, or the radial groove communicates with the annular seam through the plurality of connecting grooves, the plurality of connecting grooves are arranged at internal side of the annular seam. When the annular jet pump works, the lobe nozzle forms a plurality of radial narrow-stripy jet flows of the primary fluid. The secondary fluid is arranged between two narrow-stripy jet flows of the primary fluid, which improves the function of the central primary fluid entraining and mixing the annular mixed fluid in the central mixing chamber, and improves the mixing efficiency of the central ejector, thereby reducing the length and the weight of the central mixing duct, and improving the capacity of the annular jet pump, namely improving the total ejecting rate and the capacity of the annular jet pump suctioning the secondary fluid. The central nozzle may also be a hollow-cone-shape nozzle having a helix groove, a swirl nozzle having an internal helix groove. The central nozzle has the function of swirling the large flow, which improves the mixing efficiency of the primary fluid and the secondary fluid in the central mixing duct. The central nozzle may also be an eye-shaped-hole spray nozzle, the eye-shaped-hole spray nozzle has a plurality of straight round holes or inclining round holes uniformly and circularly arranged, a radial wedge slot is arranged at a center of the outlet of the straight round hole or inclining round hole, which forms an eye-shaped-hole sprayer port. The eye-shaped-hole spray nozzle allows the mixing of the primary fluid and the secondary fluid in the central mixing chamber, thereby reducing the length and the weight of the central mixing duct. The central mixing duct is filled with the atomization jet flow having the function of the piston and generated by few primary fluids, thereby improving the capacity of the primary fluid entraining the secondary fluid, namely the ejecting efficiency of the annular jet pump.

A throat pipe is arranged at an inlet end of the annular mixing duct, and a circular lead-cone-hole having a tapering diameter is arranged at the throat pipe, the throat pipe has the smallest diameter relative to the annular mixing duct in an axis of the annular mixing duct. The throat pipe uses the dynamic pressure of the jet flow in the throat pipe to lead to accelerate migration, mixing and filling of the non-uniform fluid in the narrow side of the throat pipe, which cuts off the connection between the front space and the rear space of the throat pipe, thus achieves the piston capacity of the primary fluid entraining the secondary fluid, thereby improving the capacity of the annular ejector entraining the secondary fluid.

The outlet of the annular mixing duct slightly exceeds the outlet of the annular mixing chamber, the central nozzle is a swirl nozzle, the swirl nozzle has a swirl core or a plurality of symmetrical inclining holes arranged uniformly at an outlet of the swirl nozzle. The annular nozzle is configured with a plurality of inclining grooves or inclining holes arranged uniformly, and a swirl direction of the annular nozzle is opposite to a swirl direction of the central nozzle. A strong mixing caused by the great shearing and a large number of local turbulence effect reduces the length of the annular mixing duct and the mixing time, the great shearing and a large number of local turbulence effect are generated at the contact border of the primary fluid and the secondary fluid by the jet flows, and the jet flows are sprayed in two opposite direction.

A middle contracting portion is arranged at a middle of the transition portion of the external pipe, a secondary annular nozzle is arranged at a front of the middle contracting portion of the transition portion of the external, and lies around a periphery of the central pipe. An inlet of the secondary annular nozzle communicates with the inner bore of the central pipe. An annular mixing duct is formed between the transition portion of the external pipe and the central pipe, and lies at a front of an outlet of the secondary annular nozzle. A secondary annular mixing chamber is formed between the transition pipe portion of the external pipe and the central pipe, and lies between the outlet of the secondary annular nozzle and a rear end of the middle contracting portion.

A secondary annular mixing duct is formed between the transition portion of the external pipe and the central pipe, and lies between an outlet of the middle contracting portion and the outlet of the central nozzle of the rear portion of the central pipe. The secondary annular ejector comprises the outlet of the annular mixing duct, the secondary annular nozzle, the secondary annular mixing chamber, and the secondary annular mixing duct.

The secondary annular nozzle is arranged in the secondary circular chamber, and the outlet of the annular mixing duct is arranged around the secondary annular nozzle, an outlet of the secondary annular nozzle faces the secondary annular mixing duct. An outlet of the secondary annular mixing duct and an inlet of the central mixing chamber smoothly butt and communicate with the central mixing duct.

The fluid from the secondary annular nozzle connected with the primary fluid inlet ejects the annular mixed fluid flowing from an outlet of the preceding stage annular mixing duct of the secondary annular nozzle, and together flow into the secondary annular mixing chamber and the secondary mixing duct, and mixed into a mixed fluid. The mixed fluid flowing from the outlet of the secondary mixing duct is ejected by the primary fluid flowing from the central nozzle, and together flow into the central mixing chamber and the central mixing duct, and mixed. The central ejector has a higher output pressure through adding the secondary annular ejector.

The secondary annular nozzle is a plurality of round holes and flat coggings circularly arranged, a combination of an annular seam and the plurality of round holes and flat coggings circularly arranged, or a combination of dual-rings configured with a plurality of round holes. These secondary annular nozzles have the simple structure and are easy to produce. The combination of dual-rings configured with the plurality of round holes allows the primary fluid ejected to impact with each other in the secondary annular mixing chamber and the secondary annular mixing duct, which improves the ejecting capacity of the annular mixed fluid flowing from the annular mixing duct, and enable the annular mixed fluid and the primary to fully mix in the secondary mixing duct.

The central pipe comprises the front portion of the central pipe and the rear portion of the central pipe. A rear of the front portion of the central pipe sleeves a periphery of a front of the rear portion of the central pipe to form the sleeve connection portion, the rear of the front portion of the central pipe and the front of the rear portion of the central pipe are in fixed connection at a front half part of the sleeve connection. The front of the rear portion of the central pipe corresponding to a middle of the sleeve connection portion is configured with a plurality of transverse through holes connected with the inner bore of the rear portion of the central pipe.

In a rear of the sleeve connection portion, the secondary annular nozzle is formed by a gap between an inner wall of the rear of the front portion of the central pipe and the periphery of the front of the rear portion of the central pipe. The gap is a successive annular seam, or the gap is a interrupted annular seam comprising a plurality of straight grooves or inclining grooves circularly and uniformly arranged; or the gap is a combination of the successive annular seam and the plurality of straight grooves or inclining grooves circularly and uniformly arranged, an inside or outside of the successive annular seam is connected with the plurality of straight grooves or inclining grooves. The production and the assembly of the secondary annular nozzle are simplified, and the simple annular jet flow and the large number of radial narrow-stripy jet flows of the primary fluid are obtained according to the need. If the grooves are the straight grooves, the large number of radial narrow-stripy jet flows of the primary fluid are direct spraying. If these grooves are the inclining grooves, the large number of radial narrow-stripy jet flows of the primary fluid are rotary spraying.

One kind of high pressure primary fluid and one or two kinds of low pressure secondary fluid or no pressure secondary are input into the annular jet pump of the present disclosure, and an annular mixed fluid is output from the annular jet pump of the present disclosure. The primary fluid and the secondary fluid may be in any one state of a liquid state, a gas state, a steam state, and a gas-liquid state, and the secondary fluid may be also in gas-solid state, e. g. smoke dust. The primary fluid the gas state or the steam state may eject the secondary fluid in the liquid state, the primary fluid in the liquid state may eject the secondary fluid in any one state of the gas state, the steam state, and the gas-solid state, the primary fluid in the liquid state may eject the secondary fluid in the liquid state, the primary fluid in any one state of the gas state and the gas-liquid state may eject the secondary fluid in the gas-solid state, and the primary fluid in the gas-liquid state may eject the secondary fluid in any one state of the gas state and the gas-solid state. The primary fluid flows into the annular jet pump from the front end, the secondary fluid flows into the annular jet pump from the side, and the primary fluid ejects the secondary fluid, and the mixed fluid is output from the bottom. The primary fluid flows into the annular jet pump from the front end, the secondary fluid flows into the annular jet pump from the side and the top, and the primary fluid ejects the secondary fluid, and the mixed fluid is output from the bottom. The annular jet pump is used as a mixed-compression, a supercharging system, a mixed transportation system, a heat transfer system, and a mass transfer of the fluid system, and the annular jet jump is also used to extract the fluid, remove waste from the fluid, separate the fluid, and process the fluid.

The first annular ejector or the secondary annular ejector is arranged at the front of the central ejector in the annular jet pump of the present disclosure, which avoids the long size and the low ejecting efficiency of the signal pipe, and simultaneously improves the ejecting rate and the output pressure. Length and weight of the annular jet pump are reduced, capacity of the annular jet pump is improved, structural variety of the annular jet jump increases, and application scope of the annular jet pump increases. The annular jet pump reduces material, reduces space, and works stably.

BRIEF DESCRIPTION OF FIGURES

FIG. 5 is a local view of a central nozzle of FIG. 4 taken from line C-C;

FIG. 6 is a local view of a second central nozzle of FIG. 4 taken from line C-C;

FIG. 7 is a local view of an annular nozzle along D direction as shown in FIG. 4;

FIG. 8 is a local view of a second annular nozzle along D direction as shown in FIG. 4;

DETAILED DESCRIPTION

Example 1

Figure 1:
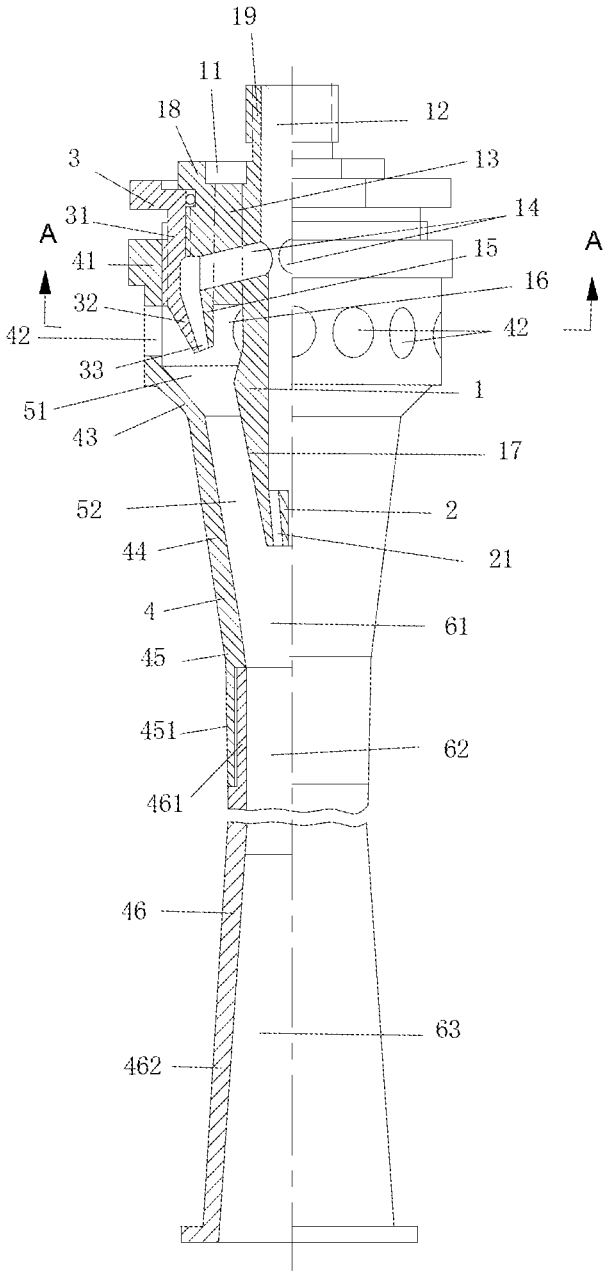
FIG. 1 is a half-sectional view of an annular jet pump of a first example of the present disclosure.
Figure 2:
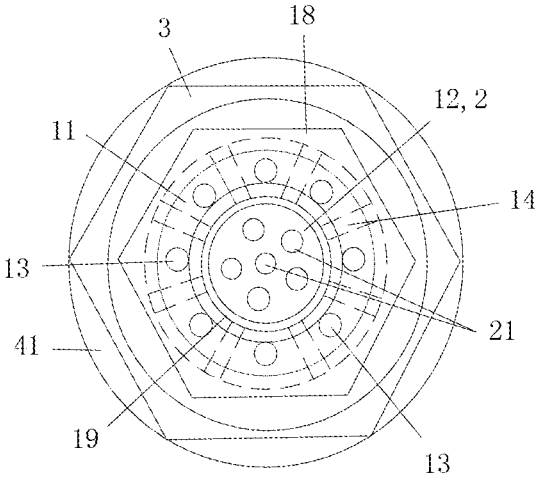
FIG. 2 is a top view of a first example of the present disclosure.
Figure 3:
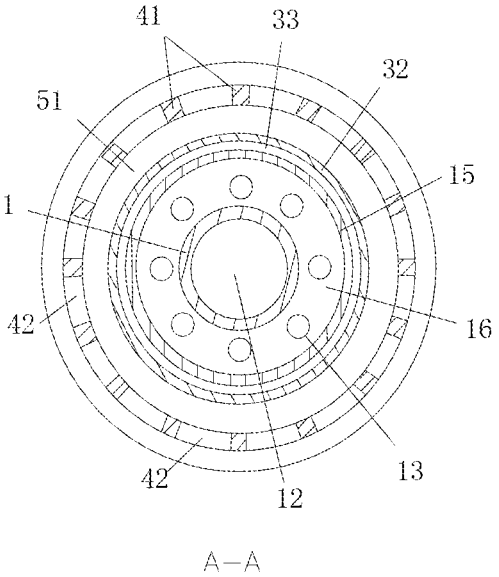
FIG. 3 is a sectional view of FIG. 1 taken from line A-A.

A first example of an annular jet pump of the present disclosure is shown in FIG. 1-FIG. 3. The annular jet pump comprises a central pipe 1, a central nozzle 2, an intermediate casing pipe 3, an external pipe 4, and a prolongation 46 of the external pipe 4, which form a central ejector and an annular ejector arranged around a periphery of the central pipe of the central ejector. The central nozzle 2 of the central ejector is arranged on an outlet end of the central pipe 1. The annular ejector comprises an annular nozzle 33 arranged around the central pipe 1, an annular mixing chamber 51, and an annular mixing duct 52 communicating with the annular mixing chamber 51. And the annular mixing duct 52 directly communicates with a central mixing chamber 61 of the central ejector. In the FIG. 1, an upper part of the FIG. 1 is a front part of the annular jet pump, and a lower part of the FIG. 1 is a back of the annular jet pump.

A front end of the central pipe 1 is a pipe joint 19 having the smallest diameter relative to the central pipe 1 in the central pipe 1, and a front of the central pipe 1 is configured with an external flange 18; a diameter of the external flange 18 is the largest in the central pipe 1. A rear 15 of the external flange 18 reduces in size towards back and forms a groove 16 toward an inside of rear 15 of the external flange 18, and a rear 17 of the central pipe 1 reduces in size towards back. As shown in FIG. 2, a front end surface of the external flange 18 is configured with a circular groove 11 surrounding the pipe joint 19, and a plurality of vertical through holes 13 uniformly arranged on the circular groove 11. The plurality of the vertical through holes 13 penetrate the front end surface and a rear end surface of the external flange 18, and reach a front surface of the groove 16. An inner bore 12 of the central pipe 1 is a round stepped hole, where a diameter of the front end of the inner bore 12 of the central pipe 1 is greater than a diameter of the rear end of the inner bore 12 of the central pipe 1, and the inner bore 12 of the central pipe 1 runs through the central pipe 1 from a front end surface of the pipe joint 19 to a rear end surface of the rear 17 of the central pipe 1 along a central axis of the central pipe. A front end of the inner bore 12 is a primary fluid inlet, and the central nozzle 2 is arranged at a rear end of the inner bore 12. The central nozzle 2 is a multi-hole nozzle having a plurality of straight holes 21 or oblique holes uniformly arranged; the central nozzle 2 also may be a cone-shaped nozzle or a scaling nozzle having a small diameter in a middle of the central nozzle 2 relative to a front end of the central nozzle and a rear end of the central nozzle 2. A plurality of transverse through holes 14 tilting forward are uniformly arranged in a middle of the external flange 18 of the central pipe 1, and the transverse through holes are connected with a root part of an end having the largest diameter of the inner bore 12. The vertical through holes 13 and adjacent transverse through holes 14 are isolated and arranged alternately in a horizontal direction.

A front end of a main body 31 of the intermediate casing pipe 3 extends outward to form an annular end cover, a rear of the main body 31 of the intermediate casing pipe 3 gradually contracts towards an end to form a circular baffle 32. The external flange 18 of the central pipe 1 and a front of the main body 31 of the intermediate casing pipe 3 are connected by a screw. An annular flow passage is formed among the rear 15 of the external flange 18 of the central pipe 1, the rear of the main body 31 of the intermediate casing pipe 3, and the circular baffle 32. The annular flow passage communicates with the inner bore 12 through all transverse through holes 14 of the central pipe 1, and a rear of the annular flow passage reduces in size towards back to form an annular seam, which forms an annular nozzle 33.

The external pipe 4 successively comprises a large-sized-diameter portion 41, a first contracting portion 43, a transition portion 44, a second contracting portion 45, and a posterior straight pipe portion 451 arranged from front to back along a central axis of the external pipe 4. The large-sized-diameter portion 41 of the external pipe 4 is a straight circular duct, and a front of the large-sized-diameter portion 41 is matched with an external thread of the intermediate casing pipe 3, a rear of the large-sized-diameter portion 41 is configured with a plurality of gas inlet holes 42. The posterior straight pipe portion 451 of the external pipe 4 is connected with a front part of a prolongation 46 of the external pipe 4 by threaded connection to form a whole structure. A middle part and a rear part of the prolongation 46 of the external pipe 4 are a cone-shaped duct portion (namely a diffuser portion 462) formed by increasingly expanding the diameter of the middle part and the rear part of the prolongation 46 of the external pipe 4 toward end.

The intermediate casing pipe 3 is fixed at the front of the large-sized-diameter portion 41 of the external pipe 4 by the threaded connection, and the front end of the large-sized-diameter portion 41 of the external pipe 4 is sealed off by the annular end cover of the intermediate casing pipe 3. The central pipe 1 is in fixed connection with a central hole of the annular end cover of the intermediate casing pipe 3 and coaxially extends into the transition portion 44 of the external pipe 4. The annular mixing chamber 51 is formed among the central pipe 1 that begins from a part corresponding to the groove 16, the large-sized-diameter portion 41 of the external pipe 4, and the first contracting portion 43. A sidewall of the annular mixing chamber 51 corresponding to the large-sized-diameter portion 41 of the external pipe 4 is configured with a plurality of the gas inlet holes 42. The annular mixing duct 52 is formed between the rear 17 of the central pipe 1 and the transition portion 44 of the external pipe 4, and the annular mixing duct 52 is diminishing back taper, and has a flow passage having a uniform cross-section and a reduced cross-section. The central mixing chamber 61 is formed by the transition portion 44 of the external pipe 4 located behind the central pipe 1 and the second contracting portion 45 of the external pipe 4, and a central mixing duct 62 is formed by the posterior straight pipe portion 451 of the external pipe 4 and a straight circular pipe portion 461 of the front of the prolongation of the external pipe 4. A diffusion duct 63 is formed by an expanding-cone portion of the diffuser portion 462 of the prolongation 46 of the external pipe 4.

The annular ejector comprises the annular nozzle 33, the annular mixing chamber 51, and the annular mixing duct 52. A first fluid inlet of the annular ejector comprises all gas inlet holes of the large-sized-diameter portion 41 of the external pipe 4, and all vertical through holes 13 of the external flange 18 of the central pipe 1 form a passage that connects an outside of the annular jet pump with a second fluid inlet of the annular mixing chamber of the annular ejector. The annular nozzle 33 extends to the annular mixing chamber 51 and faces a contracting cone mouth of a rear of the annular mixing chamber 51 and an outlet of the annular mixing duct 52, an area of an outlet of the annular nozzle 33 is smaller than an area of an inlet of the annular mixing duct 52.

The central ejector comprises the outlet of the annular mixing duct 52, the central nozzle 2, the central mixing chamber 61, the central mixing duct 62, and the total diffusion duct 63. An outlet of the central nozzle 2 and outlets of the annular mixing ducts 52 around the central nozzle 2 smoothly butt and communicate with an inlet of the central mixing chamber 61. The outlet of the central nozzle 2 faces an outlet of the central mixing duct 62. The annular nozzle is coaxially arranged the front end of the central ejector.

The primary fluid is a high pressure fluid, the first secondary fluid is atmospheric gas, and the second secondary fluid is a low pressure fluid or a no pressure fluid. The primary fluid and the second secondary fluid may be in any one state of a liquid state, a gas state, a steam state, and a gas-liquid state, and the second secondary fluid may be also in gas-solid state. According to characteristics of the primary fluid ejecting the secondary fluid and in the fluid state, the primary fluid in the gas state or the steam state may eject the atmospheric gas and the second secondary fluid in the liquid state, the primary fluid in the liquid state may eject the atmospheric gas and the second secondary fluid in any one state of the gas state, the steam state, and the gas-solid state, the primary fluid in the liquid state may eject the atmospheric gas and the second secondary fluid in the liquid state, the primary fluid in the gas state or the gas-liquid state may eject the atmospheric gas and the second secondary fluid in the gas-solid state, and the primary fluid in the gas-liquid state may eject the atmospheric gas and the second secondary fluid in any one state of the gas state and the gas-solid state.

Before using the jet pump, the second secondary fluid inlet of the central pipe communicates with an external second secondary fluid pipe, and the primary fluid inlet of the pipe joint 19 of the central pipe 1 is connected with an external primary fluid pipe. When the jet pump begins to work, the second secondary fluid flows into the external second secondary fluid pipe, and the primary fluid flows into the external primary fluid pipe.

The primary fluid from the primary fluid inlet is divided into two parts in the central pipe 1. A first part of the primary fluid flows through the annular flow passage of the annular ejector, the annular nozzle 33, and the annular mixing chamber 51, and sprays toward the inlet of the annular mixing duct 52. The first part of the primary fluid ejects the atmospheric gas entering into the annular mixing chamber 51 from the first secondary fluid inlet and the second secondary fluid entering into the annular mixing chamber 51 from the second secondary fluid inlet. The first part of the primary fluid, the atmospheric gas, and the second secondary fluid together enter into the annular mixing duct 52 and mixes, and an annular mixed fluid is output from the annular mixing duct 52. The second part of the primary fluid flows through the central nozzle 2 of the central pipe 1 of the central ejector and sprays toward the inlet of the central mixing duct 62, and the second part of the primary fluid ejects the annular mixed fluid entering into the central mixing chamber 61 from the annular ejector. The second part of the primary fluid and the annular mixed fluid together enter into the central mixing duct 62. A flow velocity, a pressure, and a mixing degree of the annular mixed fluid output from the outlet of the annular mixing duct 52 of the annular ejector is different from a flow velocity, a pressure, and a mixing degree of the primary fluid output from the central nozzle 2 of the central ejector, thus the annular mixed fluid and the primary fluid successively eject with each other and mix in the central mixing chamber 61, the central mixing duct 62, and the total diffusion duct 63 of the central ejector, which achieves a delivery of the mixed fluid of the high pressure primary fluid pumping two low pressure secondary fluids.

If the second secondary fluid flowing from the second secondary fluid inlet of the central pipe is also the atmospheric gas of the example, the atmospheric gas and the primary fluid are mixed to form the annular mixed fluid in the annular mixing chamber 51 and the annular mixing duct 52 of the annular ejector, and the annular mixed fluid and the atmospheric gas are mixed again in the central mixing chamber 61, the central mixing duct 62, and the total diffusion duct 63 of the central ejector, which achieves the mixing and delivery of the primary fluid and the atmospheric gas.

In the present disclosure, a position of the screw thread between the intermediate casing pipe 3 and the large-sized-diameter portion 41 of the external pipe 4 may be adjusted, when the position of the screw thread is changed, the central pipe 1 and the intermediate casing pipe 3 move forward and backward along the axis line relative to the external pipe 4, thus a flow path of the annular mixing duct 52 and a distance between the annular mixing duct 52 and the annular nozzle are changed, and an exemplary characteristic parameter of the annular jet pump of the present disclosure may be achieved through the above method.

Example 2

Figure 4:
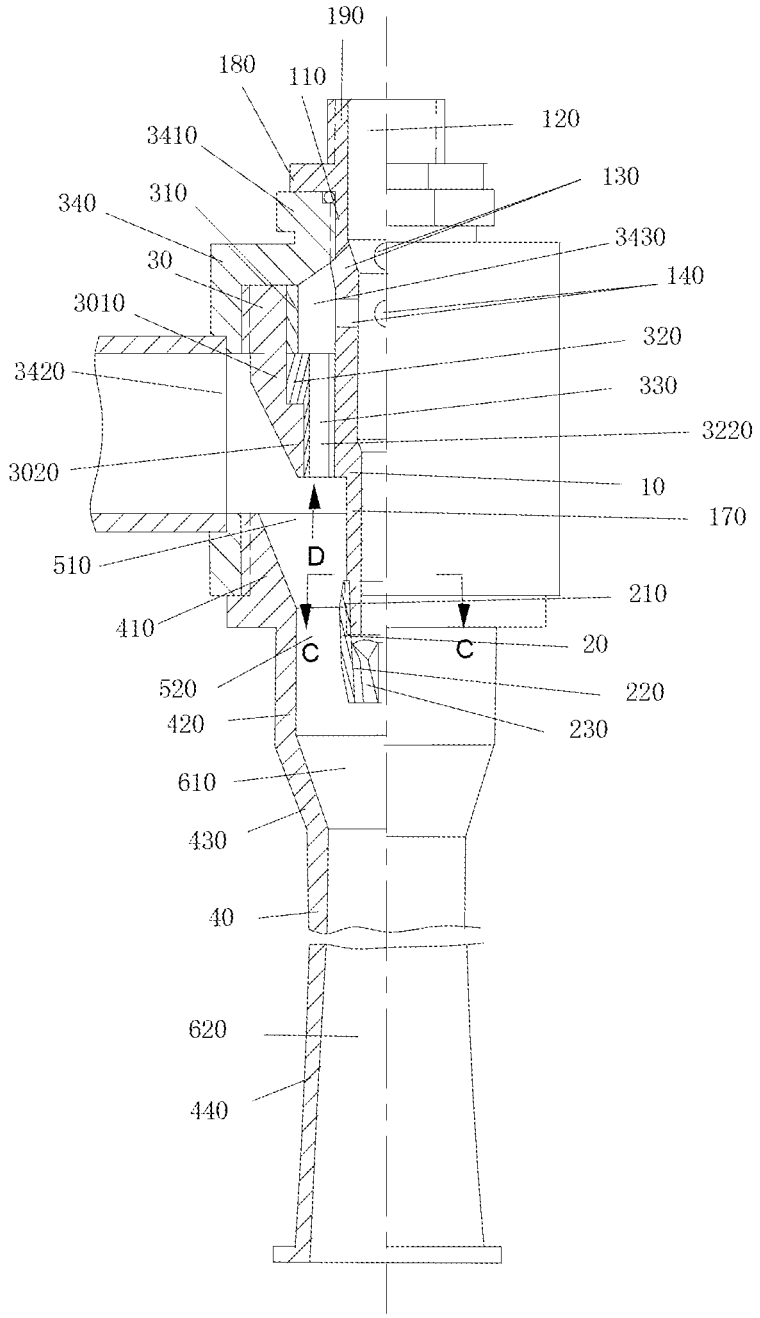
FIG. 4 is a half-sectional view of an annular jet pump of a second example of the present disclosure.

A second example of an annular jet pump of the present disclosure is shown in FIG. 4-FIG. 8. The annular jet pump comprises a central pipe 10, a central nozzle 20, an intermediate casing pipe 30, a front casing pipe 340 of an external pipe, and a main body 40 of the external pipe. In the FIG. 4, an upper part of the FIG. 4 is a fore part of the annular jet pump, and a lower part of the FIG. 4 is a back of the annular jet pump.

A front end of the central pipe 10 is a pipe joint 190 having the largest size diameter in the central pipe 10, a front and a middle of the central pipe 10 is configured with an external flange 110 having an intermediate size diameter in the central pipe 10. A hexagonal lug nut 180 is arranged between the external flange 110 and the pipe joint 190 of the central pipe 10. A front of the external flange 110 is configured with an external screw thread, and a rear 170 of the central pipe 10 is a straight pipe having the smallest diameter relative to the central pipe 10. An inner bore 120 of the central pipe 10 is a round stepped hole, and a diameter of the front end of the inner bore 120 of the central pipe 1 is greater than a diameter of the rear end of the inner bore 120 of the central pipe 1, and the inner bore 120 of the central pipe 10 runs through the central pipe 10 from a front end surface of the pipe joint 190 to a rear end surface of the rear 170 of the central pipe 10 along an axis line. A largest diameter portion of a front end of the inner bore 120 is a primary fluid inlet, and the central nozzle 20 is arranged at an outlet of the inner bore 120. A row of inclined through holes 130 tilting forward and a row of transverse through holes 140 are uniformly arranged in a middle of the external flange 110 of the central pipe 1, the inclined through holes 130 are connected to a root part of an end having the largest size diameter of the inner bore 120, and the transverse through holes 140 are connected to a front of an intermediate portion of the inner bore 120. The inclined through holes 130 and adjacent transverse through holes are isolated and arranged alternately in horizontal direction, which is different with a design in the FIG. 4 that the inclined through holes 130 and adjacent transverse through holes are isolated and arranged paratacticly in horizontal direction.

The central nozzle 20 is a lobe nozzle having a hollow lobe groove 220, which is formed by uniformly arranging a plurality of folding portions 230 bending inward at a thin-wall of the central nozzle, as shown in FIG. 5. The central nozzle 20-1 may be also a lobe nozzle having a hollow lobe groove with a larger end, which is formed by uniformly arranging a plurality of folding portions 230-1 bending inward at the thin-wall of the central nozzle, as shown in FIG. 6. The central nozzle 20 may be also a lobe nozzle having a radial groove at the bottom of the central nozzle.

A main body 3010 of the intermediate casing pipe 30 is a straight circular pipe, a rear of the main body 3010 extends toward back to form a circular baffle 3020, and an external surface of the circular baffle 3020 gradually contracts toward back.

In the example, the external pipe successively comprises a large-sized-diameter portion, a first contracting portion, a transition portion, a second contracting portion, and a posterior straight pipe portion arranged from front to back along a central axis of the external pipe. A main body of the front casing pipe 340 of the external pipe is a short fat straight circular pipe, and is the large-sized-diameter portion of the external pipe in the example. A front end of the main body of the front casing pipe 340 of the external pipe is configured with an annular end cover, which seals off the front end of the large-sized-diameter portion of the external pipe. A front of the annular end cover extends toward front to form a hexagonal lug nut 3410 having a small size. A middle of the main body of the front casing pipe 340 of the external pipe is configured with a secondary fluid inlet 3420. The hexagonal lug nut 3410 of the front casing pipe 340 of the external pipe is configured with an internal screw thread, and the external flange 110 of the external pipe 10 is connected to the hexagonal lug nut 3410 of the front casing pipe 340 of the external pipe by screw thread. The main body of the front casing pipe 340 of the external pipe is configured with the internal screw thread, a front of the internal screw of the main body of the front casing pipe 340 of the external pipe is connected to the main body 3010 of the intermediated casing pipe 3 by the screw thread, and a rear of the internal screw of the main body of the front casing pipe 340 of the external pipe is connected to a front end 410 of a main portion 40 of the external pipe by the screw thread. An inside of the front end 410 of the main portion 40 of the external pipe is a first contracting portion contracting toward back. A front of the main portion 40 of the external pipe is a straight circular transition portion 420 having an intermediate size diameter in the external pipe, and a second contracting portion 430 contracting toward back. The central pipe 10 is in fixed connection with a central hole of the annular end cover of the front casing pipe 340 of the external pipe, and coaxially extends to the transition portion 420 of the main portion 40 of the external pipe. A middle part and a rear part of the main portion 40 of the external pipe is a posterior straight pipe portion 440 having the smallest diameter relative to the external pipe.

An annular nozzle holder 320 is arranged at front of the circular baffle 3020 of the intermediate casing pipe 30, and a seal ring 310 is arranged between a front end of the nozzle holder 320 and a rear end of the hexagonal lug nut 3410 of the front casing pipe of the external pipe. As shown in FIG. 7, a gear-shaped annular nozzle 330 is arranged between the nozzle holder 320 and the rear of the external flange 110 of the central pipe 10, and the annular nozzle 330 comprises an annular seam 3302 and a plurality of radial flat coggings 3301. An annular flow passage 3340 is arranged among the seal ring 310, the rear end of the hexagonal lug nut 3410 of the front casing pipe 340 of the external pipe, the front end of the nozzle holder 320, and the external flange 110 of the central pipe 10. A front of the annular flow passage 3340 is connected with the inner bore 120 of the central pipe 10 through the plurality of inclined through holes 130 and the plurality of transverse through holes 140, and a rear of the annular flow passage 3340 communicates with an inlet of the annular nozzle 330.

It should be considered that an annular nozzle having other structures may be used, as shown in FIG. 8. The annular nozzle holder 3020-1 of the annular nozzle 330-1 is uniformly configured with a plurality of lobe grooves 3301-1. A lobe groove tube 330-1 is fixed in the plurality of lobe grooves of the annular nozzle holder 3020-1, a shape of a cross section of the lobe groove tube 330-1 is same as a shape of the lobe groove, and the lobe groove tube extends out the rear end of the nozzle holder 320-1. An annular seam 3302-1 and a plurality of having the lobe groove is arranged between the lobe groove tube and the rear of the external flange 110 of the central pipe 10, and a lobe groove annular seam comprises one annular seam 3302-1 and the plurality of radial lobe grooves.

An annular mixing chamber 510 is arranged among the intermediate casing pipe 30, the rear 170 of the central pipe 10, an inner wall of the main body of the front casing pipe 340 of the external pipe, and the first contracting portion of the main portion 40 of the external pipe. An annular mixing duct 520 is arranged between the central nozzle 20 of the rear 170 of the central pipe 10 and the transition portion 420 of the main portion 40 of the external pipe. An outlet of the annular nozzle 330 is arranged in the annular mixing chamber 510, and faces a contracting cone mouth of a rear of the annular mixing chamber 510 and an outlet of the annular mixing duct 520. An area of the outlet of the annular nozzle 330 is smaller than an area of an inlet of the annular mixing duct 520. An annular ejector comprises the annular nozzle 330, the annular mixing chamber 510, and the annular mixing duct 520. The secondary fluid inlet 3420 lied in the middle of the front casing pipe 340 of the external pipe is the secondary fluid inlet of the annular ejector.

A central mixing chamber 610 is formed by the transition portion 420 of the main portion 40 of the external pipe located behind the central nozzle 20 of the central pipe 10 and the second contracting portion of the external pipe, and a central mixing duct 620 is formed by the posterior straight pipe portion 440 of the main portion 40 of the external pipe. The central ejector comprises the outlet of the annular mixing duct 520, the central nozzle 20, the central mixing chamber 610, and the central mixing duct. An outlet of the central nozzle 20 of the central ejector and outlets of the annular mixing ducts 520 arranged around the central nozzle 20 smoothly butt and communicate with an inlet of the central mixing chamber 610. The outlet of the central nozzle 20 faces an outlet of the central mixing duct 620.

The primary fluid sprays toward the outlet of the central mixing chamber through the central nozzle, and ejects an annular mixed fluid from the annular mixing duct. The annular mixed fluid and the primary fluid flow together into the central mixing duct and are mixed again, and are output, which achieves the mixing and delivery of the primary fluid having a high pressure pumping the secondary fluid having a low pressure.

Selection of the primary fluid and the secondary fluid has been described in the first example.

Before using the jet pump, the secondary fluid inlet 3420 of the front casing pipe 340 of the external pipe communicates with an external secondary fluid pipe, and the primary fluid inlet of the pipe joint 190 of the central pipe 10 is connected with an external primary fluid pipe. When the jet pump begins to work, the secondary fluid flows into the external secondary fluid pipe, and the primary fluid flows into the external primary fluid pipe.

The primary fluid from the primary fluid inlet is divided into two parts in the central pipe 10. A first part of the primary fluid is sprayed out by the annular nozzle 330 through the annular flow passage of the annular ejector, and ejects the secondary fluid in the annular mixing chamber 510. The first part of the primary fluid and the secondary fluid flow together into the annular mixing duct 520, and mix, and an annular mixed fluid is output from the annular mixing duct 520. A second part of the primary fluid is sprayed toward the outlet of the central mixing chamber 610 through the central nozzle 20 of the central ejector, and ejects the annular mixed fluid flowing from the annular mixing duct 520. The annular mixed fluid and the second part of the primary fluid flow together into the central mixing duct. A flow velocity, a pressure, and a mixing degree of the annular mixed fluid output from the annular mixing duct 520 of the annular ejector is different with a flow velocity, a pressure, and a mixing degree of the primary fluid flowing from the central nozzle 20 of the central ejector, thus the annular mixed fluid and the primary fluid successively eject with each other and mix in the central mixing chamber 610 and the central mixing duct 620, which achieves the delivery of the mixed fluid of the high pressure primary fluid pumping the low pressure secondary fluid.

In the example, a length of the annular mixing duct 520 is short. A distance between the outlet of the annular mixing duct 520 and the outlet of the annular mixing chamber 510 in the example is less than a distance between the outlet of the annular mixing duct 52 and the outlet of the annular mixing chamber 51 in the first example. If the central nozzle is a swirl nozzle, having a swirl core or a plurality of symmetrical inclining holes, arranged uniformly at an outlet of the swirl nozzle, and the annular nozzle is a circular swirl nozzle having a plurality of inclining grooves or inclining holes arranged uniformly, and a swirl direction of the annular nozzle is opposite to a swirl direction of the central nozzle, the length of the annular mixing duct may be further shortened, namely the distance between the outlet of the annular mixing duct 520 and the outlet of the annular mixing chamber 510 is shorter, which shortens a length of the entire annular jet pump.

Example 3

Figure 9:
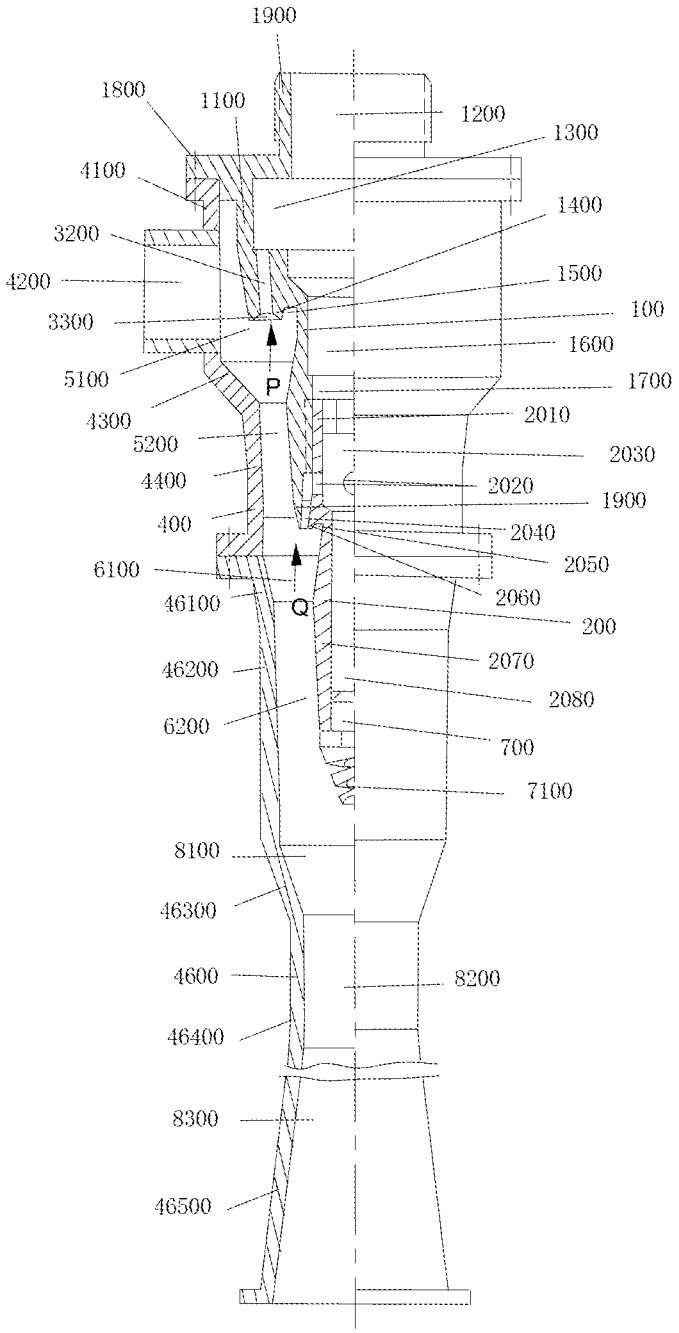
FIG. 9 is a half-sectional view of an annular jet pump of a third example of the present disclosure.

An annular jet pump of a third example of the present disclosure is shown in FIG. 9-FIG. 12. In the FIG. 9, an upper part of the FIG. 9 is a front part of the annular jet pump, and a lower part of the FIG. 9 is a back of the annular jet pump. In the annular jet pump of the third example, a central pipe comprises a front portion 100 of the central pipe and a rear portion 200 of the central pipe, and an external pipe comprises a main body 600 of the external pipe and a prolongation 4600 of the external pipe. The external pipe successively comprises a large-sized-diameter portion 4100, a first contracting portion 4300, a front transition portion 4400, a middle contracting portion 46100, a rear transition portion 46200, a second contracting portion 46300, a posterior straight pipe portion 46400, and diffuser portion 46500 arranged from the front to the back along a central axis of the external pipe. A central nozzle 700 uses a swirl nozzle or a spray nozzle.

A front end of the front portion 100 of the central pipe is a pipe joint 1900 having a large diameter, and a front of the front portion 100 of the central pipe is configured with an external flange 1100 having the largest size diameter, an annular end cover 1800 is arranged between the external flange 1100 and the pipe joint 1900. A rear of the external flange 1100 slightly reduces in size towards back, and forms a groove 1500 toward an inside of rear of the external flange 1100. A rear 1700 of the front portion 100 of the central pipe reduces in size towards back. An inner bore 1200 of the front portion 100 of the central pipe runs through the central pipe from a front end surface of the pipe joint 1900 to a rear end surface of a rear of the front portion 100 of the central pipe along a central axis of the central pipe. A front end of the inner bore 1200 is a primary fluid inlet, and an annular flow passage 1300 is arranged at a front of the inner bore 1200, and lies near the annular end cover 1800. The external flange 1100 behind the annular flow passage 1300 forms an annular nozzle holder 1400, and a first annular nozzle is arranged at the annular nozzle holder 1400. A contracting portion 1600 is arranged at a middle of the central passage 1200 corresponding to the groove 1500, and a rear of the contracting portion 1600 near a rear of the inner bore 1200 is configured with an internal screw thread. The rear of the inner bore 1200 slightly broadens toward outside.

Figure 10:
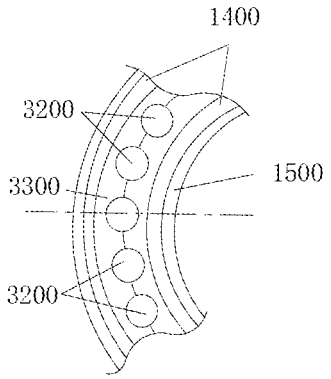
FIG. 10 is a local view of an annular nozzle along P direction as shown in FIG. 9.

As shown in FIG. 10, the first annular nozzle arranged at the annular nozzle holder 1400 comprises a circular groove 3300 and a plurality of round holes. The circular groove 3300 is arranged at a bottom of the annular nozzle holder 1400, and a cross section of the circular groove 3300 is a U shape or a V shape. The plurality of round holes are uniformly arranged in the annular nozzle holder 1400, and the round hole is a straight round hole 3200 or an inclining round hole. Outlets of the plurality of straight round holes 3200 or inclining round holes communicates with the circular groove 3300.

Figure 11:
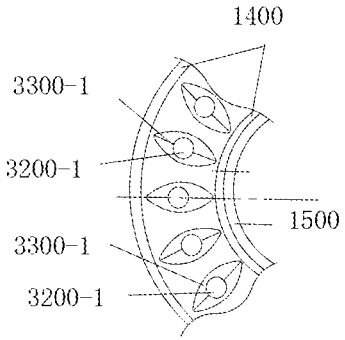
FIG. 11 is a local view of a second annular nozzle along P direction as shown in FIG. 9.

As shown in FIG. 11, the first annular nozzle comprises a plurality of straight round holes 3200 or inclining round holes uniformly arranged, and a radial wedge slot 3300-1 is arranged at a center of the outlet of the straight round hole 3200 or inclining round hole, which forms an eye-shaped-hole sprayer port.

A front end 2010 of the rear portion 200 of the central pipe is configured with an external screw thread, and a front of the rear portion 200 of the central pipe is configured with an outer convex portion 2060 having the largest size diameter in the rear portion of the central pipe. A rear end of the outer convex 2060 is configured with a groove 2050 toward an inside of the rear portion 200 of the central pipe, and a rear 2070 of the rear portion 200 of the central pipe reduces in size towards back. An inner bore of the rear portion 200 of the central pipe is a round stepped hole, and a diameter of the front end of the inner bore of the rear portion 200 of the central pipe is greater than a diameter of the rear end of the inner bore of the rear portion 200 of the central pipe. A large-sized-diameter portion 2030 of the inner bore of the rear portion 200 of the central pipe is from the front end surface of the pipe joint 1900 to a front of the groove 2050 of the outer convex portion 2060 along the central axis of the central pipe. The large-sized-diameter portion 2030 of the inner bore of the rear portion 200 of the central pipe is connected with a small-sized-diameter portion 2080 of the inner bore of the rear portion 200 of the central pipe through a transition portion reduces in size towards back, and the small-sized-diameter portion 2080 of the inner bore of the rear portion 200 of the central pipe is connected with the rear end surface of the rear portion 200 of the central pipe. A central nozzle 700 is arranged at a bottom of the small-sized-diameter portion 2080 of the inner bore of the rear portion 200 of the central pipe, and a row of transverse through holes 2020 are arranged between the front end 2010 of the rear portion 200 of the central pipe and the outer convex portion 2060, the transverse through holes 2020 communicate with the large-sized-diameter portion 2030 of the inner bore of the rear portion 200 of the central pipe.

The central nozzle 700 is a hollow-cone-shaped nozzle having a helix groove, a cone-shaped nozzle head extends out the rear of the small-sized-diameter portion 2080 of the central passage of the rear portion 200 of the central pipe. An outside surface of the cone-shaped nozzle head is configured with the helix groove communicating with the inner bore of the central nozzle. The central nozzle may use a swirl nozzle having an internal helix groove, and the central nozzle may also use a plurality of straight round holes or inclining round holes uniformly and circularly arranged. The radial wedge slot is arranged at each of the centers of the outlets of the straight round holes or inclining round holes, which forms the eye-shaped-hole sprayer port.

Figure 12:
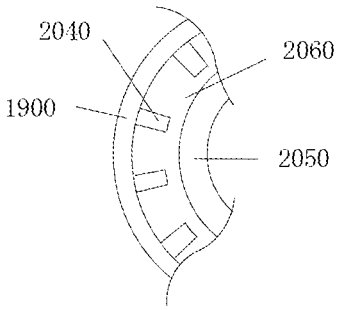
FIG. 12 is a local view of a secondary nozzle along Q direction as shown in FIG. 9.

The rear of the front portion 100 of the central pipe sleeves a periphery of the front of the rear portion 200 of the central pipe to form a sleeve connection portion, and the front portion 100 is fixed at the rear portion 200 through the internal screw thread and the external screw thread at a first half of the sleeve connection portion, which enable the front portion 100 of the central pipe and the rear portion 200 of the central pipe form an entire central pipe. The through holes 2020 arranged at the front of the rear portion of the central pipe is arranged at a middle of the sleeve connection portion. In a rear of the sleeve connection portion, a secondary annular nozzle 2040 is formed by a gap between the rear end of the front portion 100 of the central pipe and a last half of the outer convex portion 2060 of the rear portion 200 of the central pipe. As shown in FIG. 12, the gap is an interrupted annular seam comprising a plurality of straight grooves or inclining grooves circularly and uniformly arranged. The gap may also be a combination of the successive annular seam and the plurality of straight grooves or inclining grooves circularly and uniformly arranged, and an inside or outside of the successive annular seam is connected with the plurality of straight grooves or inclining grooves circularly and uniformly arranged. The transverse through holes 2020 connect an inlet of the secondary annular nozzle 2040 with the large-sized-diameter portion 2030 of the central passage of the rear portion 200 of the central pipe.

The main body 400 of the external pipe is configured with a large-sized-diameter portion 4200, a first contracting portion 4300, and a front transition pipe portion 4400 from the front to the rear of the main body of the external pipe along the axis of the external pipe. The first contracting portion 4300 and the front transition pipe portion 4400 shrink toward back, and a rear end of the main body 400 of the external pipe is configured with a flange plate. A transverse secondary fluid inlet is arranged at a sidewall of the large-sized-diameter portion 4200 of the main body 400 of the external pipe.

A middle contracting portion 46100 shrinking toward back is arranged at the front end of the prolongation 4600 of the external pipe, and a front end of the middle contracting portion 46100 is configured with the flange plate that is in fixed connection with the flange plate arranged at the rear end of the main body 400 of the external pipe, which allows the main body 400 of the external pipe and the prolongation 4600 of the external pipe to form an entire external pipe. The rear transition portion 46200 is connected with a rear end of the middle contracting portion 46100 of the prolongation 4600 of the external pipe, and a second contracting portion 46300 is connected with a rear of the rear transition portion 46200. A rear of the prolongation 4600 of the external pipe comprises a posterior straight pipe portion 46400 and a diffuser portion 46500, and diameter of the posterior straight pipe portion is the smallest in the external pipe.

The annular end cover 1800 of the front portion 100 of the central pipe is in fixed connection with the front end of the large-sized-diameter portion 4200 of the main body 400 of the external pipe, and the annular end cover 1800 seals off the front end of the large-sized-diameter portion 4200 of the main body 400 of the external pipe, which allows the central pipe to coaxially sleeve the external pipe from the front of the central pipe. The first annular nozzle 3300 extends to an inner cavity of the large-sized-diameter portion 4200 of the main body 400 of the external pipe, the secondary annular nozzle 2040 arranged at the rear of the front portion 100 of the central pipe extends to a bottom of the front transition pipe portion 4400 of the external pipe, and lies at the front of the middle contracting portion 46100. The rear 2070 of the rear portion 200 of the central pipe extends to a bottom of the rear transition portion 46200 of the external pipe.

A first annular mixing chamber 5100 is formed among the front portion 100 of the central pipe behind the groove 1500, the large-sized-diameter portion 4200 of the main body 400 of the external pipe, and the first contracting portion 4300. A first annular mixing duct 5200 is formed between the front transition portion 4400 of the external pipe and the rear of the front portion 100 of the central pipe, and lies at the front of the second annular nozzle 2040. A first annular ejector comprises the first annular nozzle 3300, the first annular mixing chamber 5100, and the first annular mixing duct 5200. The first annular nozzle 3300 extends into the first annular mixing chamber 5100, and faces a contracting cone mouth of a rear of the first annular mixing chamber 5100 and an outlet of the first annular mixing duct 5200, an area of an outlet of the first annular nozzle 3300 is smaller than an area of an inlet of the annular mixing duct 5200.

A secondary annular mixing chamber 6100 is formed between the front transition pipe portion 4400 of the external pipe and the rear portion 200 of the central pipe, and lies between the groove 2050 and the rear end of the middle contracting portion 46100. A secondary annular mixing duct 6200 is formed between the rear transition portion 46200 of the external pipe and the rear portion 200 of the central pipe, lies between the outlet of the middle contracting portion 46100 and the outlet of the central nozzle 700 of the rear portion 200 of the central pipe. The secondary annular ejector comprises the outlet of the first annular mixing duct 5200, the secondary annular nozzle 2040, the secondary annular mixing chamber 6100, and the secondary annular mixing duct 6200. The outlet of the first annular mixing duct 5200 forms a secondary fluid inlet of the secondary annular ejector. The secondary annular nozzle 2040 is arranged in the secondary circular chamber 6100, the outlet of the first annular mixing duct 5200 is arranged around the secondary annular nozzle 2040, and an outlet of the secondary annular nozzle 2040 faces the outlet of the secondary annular mixing duct 6200.

A central mixing chamber 8100 is formed by the rear transition portion 46200 of the external pipe behind the central nozzle 700 of the rear portion 200 of the central pipe and the second contracting portion 46300, and a central mixing duct 8200 is formed by the straight round hole of the posterior straight pipe portion 46400. A diffusion duct 8300 is formed by the cone-shaped inner bore of the diffuser portion 46500 of the external pipe. An outlet of the secondary annular mixing duct 6200 and an inlet of the central mixing chamber 8100 smoothly butt and communicate with the central mixing duct 8200 and the diffusion duct 8300. The outlet of the central nozzle 700 faces the outlets of the central mixing duct 8200 and the diffusion duct 8300. The central ejector is formed by the outlet of the secondary annular mixing duct 6200, the central nozzle 700, the central mixing chamber 8100, the central mixing duct 8200, and the diffusion duct 8300. The annular ejector is coaxially arranged at the front of the central ejector, the outlet of the secondary annular mixing duct 6200 is the secondary fluid inlet of the central ejector.

Selection of the primary fluid and the secondary fluid has been described in the first example.

Before using the jet pump, the secondary fluid port 4200 of the external pipe is connected with an external secondary fluid pipe, and the primary fluid port is connected with an external primary fluid pipe through the pipe joint 1900 of the front portion 100 of the central pipe 10. When the jet pump begins to work, the secondary fluid flows into the external secondary fluid pipe, and the primary fluid flows into the external primary fluid pipe.

The primary fluid from the primary fluid inlet is divided into three parts in the central pipe. A first part of the primary fluid flows through annular flow passage 1300 of the annular ejector and sprays out from the first annular nozzle 3300, and ejects the secondary fluid in the annular mixing chamber 5100. The first part of the primary fluid and the secondary fluid flow enter together into the first annular mixing duct 5200, and mix, and a first annular mixed fluid is output from the annular mixing duct 5200. A second part of the primary fluid flows through the rear portion 200 of the central pipe, and sprays out from the secondary annular nozzle 2040 arranged at the secondary annular ejector. Then the second part of the primary fluid ejects the first annular mixed fluid in the secondary annular mixing chamber 6100 flowing from the first annular mixing duct 5200. The first annular mixed fluid and the second part of the primary fluid flow enter together into the secondary annular mixing duct 6200, and mix, and a second circular mixed fluid is output from the secondary annular mixing duct 6200. A third part of the primary fluid is sprayed toward the inlet of the central mixing duct 8200 through the central nozzle 700 arranged at the rear end of the rear portion 200 of the central pipe, and ejects the second annular mixed fluid in the central mixing chamber 8100 flowing from the secondary annular ejector. The second annular mixed fluid and the third part of the primary fluid flow together into the central mixing duct 8200. A flow velocity, a pressure, and a mixing degree of the second annular mixed fluid flowing from the secondary annular mixing duct 6200 of the secondary annular ejector is different from a flow velocity, a pressure, and a mixing degree of the primary fluid flowing from the central nozzle 700 of the central ejector, thus the second annular mixed fluid and the primary fluid successively eject with each other and mix in the central mixing chamber 8100 and the central mixing duct 8200, which achieves a delivery of the mixed fluid of the high pressure primary fluid pumping the low pressure secondary fluid.

It should be considered that the secondary annular nozzle holder may be arranged at the middle of the central pipe, the annular nozzle may be the plurality of round holes circularly and uniformly arranged at the secondary circular holder, the plurality of flat coggings circularly and uniformly arranged between the secondary circular holder and the central pipe, or the combination of the annular seam and the plurality of round holes or flat coggings circularly and uniformly arranged, the annular seam is arranged between the secondary circular holder and the central pipe.

The above contents mentioned are the specific exemplary examples of the present disclosure. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

I claim:

1. An annular jet pump, comprising:

a central ejector comprising a central pipe, a central nozzle arranged at an outlet end of the central pipe, a central mixing chamber, and a central mixing duct; and a plurality of annular ejectors arranged around a periphery of the central pipe of the central ejector;

wherein each annular ejector of the plurality of annular ejectors comprises an annular nozzle arranged around the central pipe, an annular mixing chamber, and an annular mixing duct directly communicating with the annular mixing chamber;

wherein an outlet of the annular mixing duct directly communicates with an inlet of the central mixing chamber of the central ejector, and an outlet of the central mixing chamber directly communicates with the central mixing duct; a primary fluid inlet arranged at an inlet end of the annular jet pump communicates with the central nozzle and the annular nozzle, a secondary fluid inlet arranged around the inlet end of the annular jet pump directly communicates with the annular mixing chamber; and a secondary annular ejector arranged at an outlet end of each annular ejector of the plurality of annular ejectors, wherein a secondary annular nozzle of the secondary annular ejector is arranged at an outlet of the secondary annular ejector, and the secondary annular nozzle of the secondary annular ejector directly communicates with a secondary annular mixing chamber of the secondary annular ejector; the outlet of the secondary annular ejector directly communicates with the central mixing chamber of the central ejector, wherein the central pipe is configured with a through hole; an outlet of the secondary annular nozzle is arranged in the secondary annular mixing chamber, and the outlet of the secondary annular nozzle faces a secondary annular mixing duct; an inlet of the secondary annular nozzle communicates with an inner bore of the central pipe through the through hole of the central pipe.

2. The annular jet pump of claim 1, wherein an annular seam communicates with an inlet of the annular nozzle of each annular ejector of the plurality of annular ejectors, and the annular seam communicates with the inner bore of the central pipe through the through hole of the central pipe.

3. The annular jet pump of claim 1, wherein the annular nozzle of each annular ejector of the plurality of annular ejectors moves forward and backward to change a flow path of the annular mixing duct and a distance between the annular mixing duct and the annular nozzle.

4. The annular jet pump of claim 1, wherein the outlet of the central mixing chamber of the central ejector is funnel-shaped with a contracted cone, and the funnel-shaped outlet smoothly connects with an inlet of the central mixing duct the central mixing duct is a straight circular duct, and a diffusion duct is arranged at a bottom of the central mixing duct, the diffusion duct is a cone-shaped duct having an increasingly expanding diameter along an axis of the central mixing duct.

5. The annular jet pump of claim 1, wherein each annular ejector of the plurality of annular ejectors is configured with a first fluid inlet and a second fluid inlet.

6. An annular jet pump, comprising:

an external pipe successively comprising a large-sized-diameter portion, a first contracting portion, a transition portion, a second contracting portion, and a posterior straight pipe portion arranged from front to back along a central axis of the external pipe;

an annular end cover sealing off a front port of the large-sized-diameter portion of the external pipe;

a central pipe that is in fixed connection with a central hole of the annular end cover and coaxially extends into the transition portion of the external pipe;

a central nozzle; and an annular nozzle;

wherein a front end of an inner bore of the central pipe is configured with a primary fluid inlet and a rear end of the inner bore of the central pipe is configured with the central nozzle; the annular nozzle is arranged between the central pipe and the large-sized-diameter portion of the external pipe, and an annular flow passage is formed between the annular end cover and the annular nozzle, the annular flow passage communicates with the inner bore of the central pipe and an inlet of the annular nozzle;

an annular mixing chamber is formed among the central pipe behind the annular nozzle, the large-sized-diameter portion of the external pipe, and the first contracting portion; a secondary fluid inlet is arranged at a sidewall of the annular mixing chamber corresponding to the large-sized-diameter portion of the external pipe, an annular mixing duct is formed between the central pipe and the transition portion of the external pipe; a central mixing chamber is formed by the transition portion of the external pipe located behind the central pipe and the second contracting portion of the external pipe, and a central mixing duct is formed by the posterior straight pipe portion of the external pipe;

an annular ejector is formed by the annular nozzle, the annular mixing chamber, and the annular mixing duct; a central ejector is formed by an outlet of the annular mixing duct, the central nozzle, the central mixing chamber, and the central mixing duct; the annular ejector is coaxially arranged at a front end of the central ejector;

an outlet of the annular nozzle of the annular ejector extends into the annular mixing chamber, and faces a contracting cone mouth of a rear of the annular mixing chamber and the outlet of the annular mixing duct;

an outlet of the central nozzle of the central ejector and the outlet of the annular mixing duct around the central nozzle smoothly butt and directly communicate with an inlet of the central mixing chamber, and the outlet of the central nozzle faces an outlet of the central mixing duct.

7. The annular jet pump of claim 6, wherein an external flange is arranged at a periphery of the central pipe near the annular end cover, and an intermediate casing pipe is arranged between the external flange and a front end of the large-sized-diameter portion of the external pipe, the intermediate casing pipe moves forward and backward between the external flange and the front end of the large-sized-diameter portion of the external pipe; the annular nixing duct is diminishing back taper, and has a flow passage having a uniform cross-section and a reduced cross-section.

8. The annular jet pump of claim 7, wherein the annular flow passage and the annular nozzle are formed between the external flange of the central pipe and the intermediate casing pipe.

9. The annular jet pump of claim 8, wherein the annular nozzle comprises an annual seam and a groove arranged circularly and uniformly between the external flange of the central pipe and the intermediate casing pipe; the annual seam is circular, a lobe groove or as flat cogging; a cross section of the groove arranged circularly and uniformly is radial distribution; a longitudinal section of the groove arranged circularly and uniformly is parallel or inclined to a central axis of the annular nozzle.

10. The annular jet pump of claim 7, wherein the external flange is configured with a plurality of vertical through holes and transverse through holes that arranges alternately and are isolated to each other; the vertical through holes passes through a front end and a rear end of the external flange of the central pipe, and connects a second secondary fluid inlet of the annular mixing chamber with an outside; the transverse through holes connects the inner bore of the central pipe with the annular flow passage.

11. The annular et pump of claim 6, wherein the annular nozzle comprises a plurality of straight round holes or inclining round holes arranged circularly and uniformly, the plurality of straight round holes or inclining round holes are arranged at an annular nozzle holder; the annular nozzle holder is arranged between the central pipe and the external pipe; or wherein the annular nozzle comprises a circular groove having a U-shaped cross section or a V-shaped cross section, and the plurality of straight round holes or inclining round holes arranged circularly and uniformly; the circular groove is arranged at a bottom of the annular nozzle holder, and the plurality of straight round holes or inclining round holes are arranged at the annular nozzle holder, the annular nozzle holder is arranged between the central pipe and the external pipe; outlets of the plurality of straight round holes or inclining round holes are connected with the circular groove; or wherein the annular nozzle comprises the plurality of straight round holes or inclining round holes arranged circularly and uniformly, the plurality of straight round holes or inclining round holes are arranged at the annular nozzle holder arranged between the central pipe and the external pipe; a radial wedge slot is arranged at a center of the outlet of the straight round hole or inclining round hole, which forms an eye-shaped-hole sprayer port.

12. The annular jet pump of claim 6, wherein the central nozzle is a cone-shaped nozzle;

the central nozzle is a scaling nozzle having a small diameter in a middle of the central nozzle relative to a from end of the central nozzle and a rear end of the central nozzle;

the central nozzle is a multi-hole nozzle having a plurality of straight holes or oblique holes uniformly arranged;

the central nozzle is a lobe nozzle having a hollow lobe groove, a hollow lobe groove with a large end, or a radial groove;

the central nozzle is a hollow-cone-shaped nozzle having a helix groove;

the central nozzle is a swirl nozzle having an internal helix groove; or the central nozzle is an eye-shaped-hole spray nozzle having a plurality of straight round holes or inclining round holes arranged uniformly and circularly, a radial wedge slot is arranged at a center of the outlet of the straight round hole or inclining round hole, which forms an eye-shaped-hole sprayer port.

13. The annular jet pump of claim 12, wherein a throat pipe is arranged at an inlet end of the annular mixing duct, and a circular lead-cone-hole having a tapering diameter is arranged at the throat pipe, the throat pipe has the smallest diameter relative to the annular mixing duct in an axis of the annular mixing duct.

14. The annular jet pump of claim 6, wherein the central nozzle is a swirl nozzle, the swirl nozzle has a swirl core or a plurality of symmetrical inclining holes arranged uniformly at an outlet of the swirl nozzle; the annular nozzle is configured with a plurality of inclining grooves or inclining holes arranged uniformly, and a swirl direction of the annular nozzle is opposite to a swirl direction of the central nozzle.

15. The annular jet pump of claim 12, wherein a middle contracting portion is arranged at a middle of the transition portion; the central pipe comprises a front portion and a rear portion that having a concentric sleeve connection; a secondary annular nozzle is formed at an annular gap located at a sleeve connection portion between the front portion and the rear portion of the central pipe, and an inlet of the secondary annular nozzle communicates with the inner bore of the central pipe;

the annular mixing duct is formed between the transition portion of the external pipe and the central pipe, and lies at a front of an outlet of the secondary annular nozzle; a secondary annular mixing chamber is formed between the transition portion of the external pipe and the central pipe, and lies between the outlet of the secondary annular nozzle and a rear end of the middle contracting portion;

a secondary annular mixing duct is formed between the transition portion of the external pipe and the central pipe, and lies between an outlet of the middle contracting portion and the outlet of the central nozzle of the rear portion of the central pipe; a secondary annular ejector comprises the outlet of the annular mixing duct, the secondary annular nozzle, the secondary annular mixing chamber, and the secondary annular mixing duct;

the secondary annular nozzle is arranged in a secondary circular chamber, and the outlet of the annular mixing duct is arranged around the secondary annular nozzle, an outlet of the secondary annular nozzle faces the secondary annular mixing duct; an outlet of the secondary annular mixing duct and an inlet of the central mixing chamber smoothly butt and communicate with the central mixing duct;

wherein fluid from the secondary annular nozzle connected With the primary fluid inlet ejects an annular mixed fluid flowing from an outlet of a preceding stage annular mixing duct of the secondary annular nozzle, and together flow into the secondary annular mixing chamber and the secondary mixing duct, and mixed into a mixed fluid; the mixed fluid flowing from the outlet of the secondary mixing duct is ejected by the primary fluid flowing from the central nozzle, and together flow into the central mixing chamber and the central mixing duct, and mixed.

16. The annular jet pump of claim 15, wherein the secondary annular nozzle is a plurality of round holes and flat coggings circularly arranged;

the secondary annular nozzle is a combination of a annular seam and the plurality of round holes or flat coggings circularly arranged; or the secondary annular nozzle is a combination of dual-rings configured with a plurality of round holes.

17. The annular jet pump of claim 15, wherein the central pipe comprises the front portion of the central pipe and the rear portion of the central pipe; a rear of the front portion of the central pipe sleeves a periphery of a front of the rear portion of the central pipe to form the sleeve connection portion, the rear of the front portion of the central pipe and the front of the rear portion of the central pipe are in fixed connection at a front half part of the sleeve connection portion;

the front of the rear portion of the central pipe corresponding to a middle of the sleeve connection portion is configured with a plurality of transverse through holes connected with the inner bore of the rear portion of the central pipe;

in a rear of the sleeve connection portion, the secondary annular nozzle is formed by a gap between an inner wall of the rear of the front portion of the central pipe and the periphery of the front of the rear portion of the central pipe;

the gap is a successive annular seam; or the gap is a interrupted annular seam comprising a plurality of straight grooves or inclining grooves circularly and uniformly arranged; or the gap is a combination of the successive annular seam and the plurality of straight grooves or inclining grooves circularly and uniformly arranged, an inside or outside of the successive annular seam is connected with the plurality of straight grooves or inclining grooves.

* * * * *